United States Patent [19]

Pagano

[11] Patent Number: 4,467,951

[45] Date of Patent: Aug. 28, 1984

[54] APPARATUS FOR NAILING PICKETS ON STRINGERS

[76] Inventor: Anthony L. Pagano, 909 Raritan Ave., Highland Park, N.J. 08904

[21] Appl. No.: 339,337

[22] Filed: Jan. 15, 1982

[51] Int. Cl.[3] ..... B27F 7/02

[52] U.S. Cl. ..... 227/48; 227/45; 227/99; 227/100

[58] Field of Search ..... 227/45, 48, 101, 99, 227/100

[56] References Cited

U.S. PATENT DOCUMENTS

| | | | |
|---|---|---|---|
| 2,523,830 | 9/1950 | Klasey et al. | 227/100 X |
| 3,637,126 | 1/1972 | Heterick, Jr. | 227/100 X |
| 3,763,547 | 10/1973 | Blakeslee | 227/48 X |
| 3,822,815 | 7/1974 | Davis | 227/100 X |
| 3,945,549 | 3/1976 | Colson | 227/45 |
| 4,039,112 | 8/1977 | Schultz | 227/48 X |
| 4,054,236 | 10/1977 | Paxton | 227/45 |
| 4,305,538 | 12/1981 | Schultz | 227/101 X |

*Primary Examiner*—E. R. Kazenske
*Assistant Examiner*—Willmon Fridie, Jr.
*Attorney, Agent, or Firm*—Arthur L. Plevy

[57] ABSTRACT

Apparatus for securing pickets to elongated stringers employs a worktable having stringer accomodating channels into which the elongated stringers are placed. A picket hopper accomodates a stacked array of pickets transverse to said channels and stringers. A reciprocating carriage assembly is positioned on the worktable and reciprocates a given distance in a forward and backward movement. As the carriage moves forward the lower most picket in said hopper is pushed to a fastening location. Located at this location and above the pushed picket are fastening means, which are air actuated nailing guns. The guns are mounted on a shaft which is synchronized with the carriage assembly to cause the guns to move about an arcuate path which causes the guns to contact the picket at the fastening location to secure the same to the stringers. Also including are side locking means which are located in the stringer channels and which force the stringers against the vertical channel walls during carriage motion to provide a consistent product. The operation is automatic and each successive picket is secured to the stringers by the carriage pushing the next picket against the last picket nailed. In this manner the carriage assembly pushes the completed product away from the fastening location at increments equal to the picket width and this action occurs for a picket of any width. The action of the apparatus further assures that each picket is straightened or aligned with the last secured picket due to the forces exerted on the pickets by the carriage assembly. Other features as synchronizing means for the entire operation are described.

10 Claims, 7 Drawing Figures

APPARATUS FOR NAILING PICKETS ON STRINGERS

BACKGROUND OF INVENTION

This invention relates in general to an automatic apparatus which operates to secure or nail a plurality of pickets transversely on stringers and more particularly to such apparatus for manufacturing picket fences such as stockade and board fences.

The prior art is replete with a number of patents which show and describe machines and apparatus of various types for automatically constructing or nailing slats or pickets transversely on backing rails or stringers. Many of these devices provide a more efficient technique of fabricating such a structure as compared to the hand fabrication of the unit. In any event, there is a need for a more efficient and reliable apparatus which will provide the fence manufacturing industry with a simpler and more efficient method of assembling various heights of picket, stockade and board fences.

In prior art devices certain apparatus employed conveyor belt systems for transporting both pickets and stringers during assembly. These devices were relatively complicated and required much maintenance, as well as operator assistance in order to properly use the device. An example of such a device is depicted in U.S. Pat. No. 4,054,236 issued on Oct. 18, 1977 to G. C. Paxton. This device employs a reversible conveyor which included chucks on the conveyor which operated to grasp and position stringers in parallel relationship. The conveyor operated to advance the structure towards a nailing station in incremental steps where the increments were mechanically controlled by indexing means. Still other patents as U.S. Pat. No. 3,945,549 entitled AUTOMATIC STITCH NAILING APPARATUS issued on Mar. 23, 1976 to D. W. Colson show different techniques. In this patent first and second conveyors are employed and are controlled in sequence. The conveyors are operated to provide alternate movement. The patent shows the use of electromechanical control means which automatically senses the nailing of a slat to the stringers to cause the cycle to repeat.

U.S. Pat. No. 3,576,286 issued on Apr. 27, 1971 to T. J. Bunch entitled AUTOMATIC FASTENING MACHINE, shows a carriage which carries fastening guns and which moves over a work piece to automatically nail slats to stringers.

Other patents as U.S. Pat. No. 3,763,547 and U.S. Pat. No. 4,039,112 depict different apparatus for fastening slats to stringers.

As one can ascertain, the prior art is replete with many patents which relate to different mechanisms for performing the same function, that is, such prior art patents are concerned with the attachment of slats or pickets to stringers or backing rails automatically and as rapidly as possible. As one can ascertain by reading the above noted patents, such devices are extremely complicated and consist of many moving parts and are therefore both difficult to use and to maintain.

It is therefore an object of the present invention to provide an automatic apparatus for attaching pickets to stringers which machine is relatively simple, in that it employs few moving parts while providing rapid operation.

The machine to be described employs pneumatic cylinders and valves which control a reciprocating carriage assembly. A predetermined number of pickets are stacked vertically in a hopper which hopper is mounted in proximity to the carriage assembly. As the carriage reciprocates, the lower most picket is pushed on to a stringer assembly, and based on the machine operation, is secured in place by means of pneumatic nailing assemblies which are synchronized to activate by means of a rotatable offset shaft assembly which moves the nailing assemblies in a closed arcuate path as synchronized by the movement of the carriage.

BRIEF DESCRIPTION OF THE PREFERRED EMBODIMENT

Apparatus for securing pickets transversely to elongated stringers, comprising a relatively horizontal work surface, hopper means located on the surface of said table and adapted to hold a predetermined number of pickets in a vertical stacked relationship with respect to the surface of said work surface, a channel assembly located on said work surface and transverse to said hopper means and adapted to support at least one elongated stringer, a carriage assembly mounted above said channel assembly and adapted to moveably reciprocate with respect to said hopper always at given distance in a foward and back direction, means coupled to said carriage assembly to reciprocate the same said fixed distance to push one picket from said hopper to a fastening location, at least one fastening means located at said location and positioned above said picket, said fastening means operative to move in an arcuate path to contact said picket and to secure the same to said stringer when said arcutate path causes said fastening means to contact said picket when said carriage is operated in said foward direction at said given distance.

DETAILED DESCRIPTION OF THE INVENTION

Figure 1:
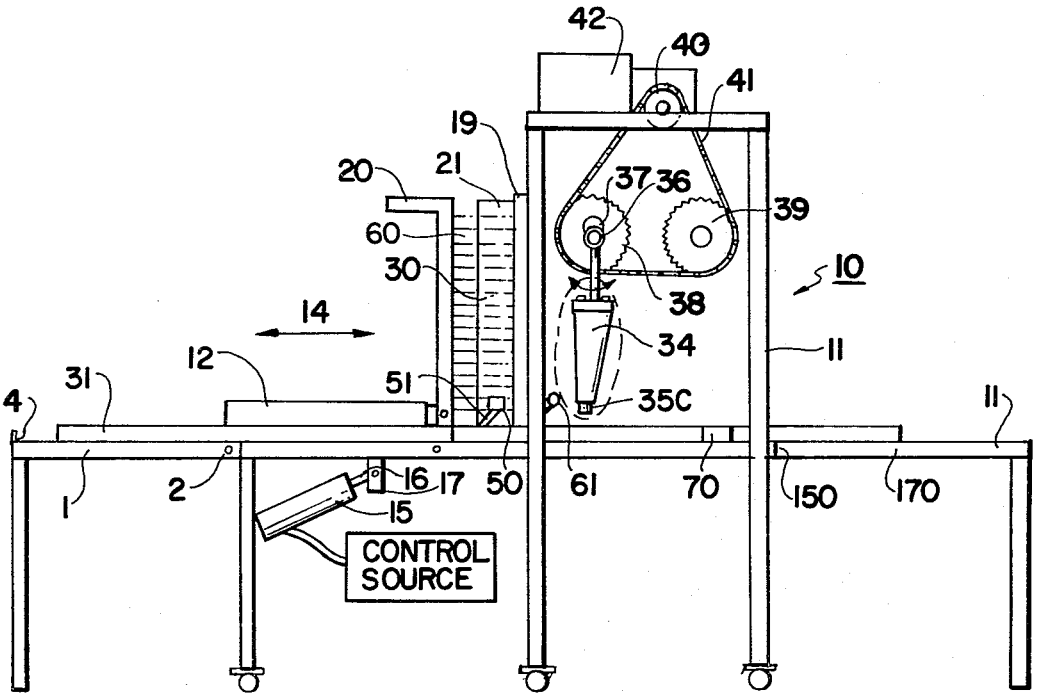
FIG. 1 is a side elevational view of the apparatus for securing pickets to stringers according to this invention.

Referring to FIG. 1, there is shown an automatic apparatus for nailing pickets on stringers according to this invention.

The apparatus 10 is depicted in a side view. Essentially the apparatus comprises a relatively horizontal worktable 11 which includes a reciprocating carriage 12.

As will be explained, the carriage 12 is a frame like member of a rectangular configuration and is controlled to reciprocate or move in the direction of arrow 14 under the influence of a pneumatic cylinder 15. The cylinder 15 has one end permanently secured to the frame assembly. The piston 16, associated with the cylinder is attached to a bracket 17 which is secured to the carriage to provide reciprocal motion. Coupled to the cylinder assembly 15 is a hydraulic source which is also secured to the frame at a convenient location. As will be explained, the control of the cylinder assembly 15 is implemented by means of a pneumatic valve which therefore causes the carriage as activated by the piston to move. The valve which operates the piston 15 is shown in schematic form in FIG. 6. In any event, the valve may be a four way pneumatic valve. In this manner the cylinder 15 is of the type having an actuated port to allow air to enter to raise the piston 16 and another port which allows air to enter to lower the piston 16. Cylinders of this type are well-known, as well as the control of such cylinders by four way pneumatic valves.

Located on the frame of the apparatus are guide posts 19 and 20. There are other posts as 19 and 20 on each side, as well as additional posts parallel to 19 and 20 for supporting a stack of pickets. Guide post 20 is adjustably mounted on the frame and can be moved with respect to post 19 to accomodate a plurality of stacked pickets. The pickets 30 are shown in dashed line configuration in FIG. 1 and are arranged between the supporting posts 19 and 20 in a stacked array. As one can determine, due to the effective height of posts 19 and 20, and for convenience, a fixed number of pickets, each of a given thickness can be stacked between the posts. For example, many fences today use a picket which is approximately 2¾ in width. Hence the spacing between members 19 and 20 is 2¾. The height of the pickets may vary but they are approximately a ½". For example, in order to fabricate a length of fence of about 8 feet, one requires appxoximately 34 pickets. The hopper, as defined by the posts 19 and 20 is designed to accomodate 34 pickets to enable a manufacturer to produce 8 feet length fence sections during a single operation.

Figure 2:
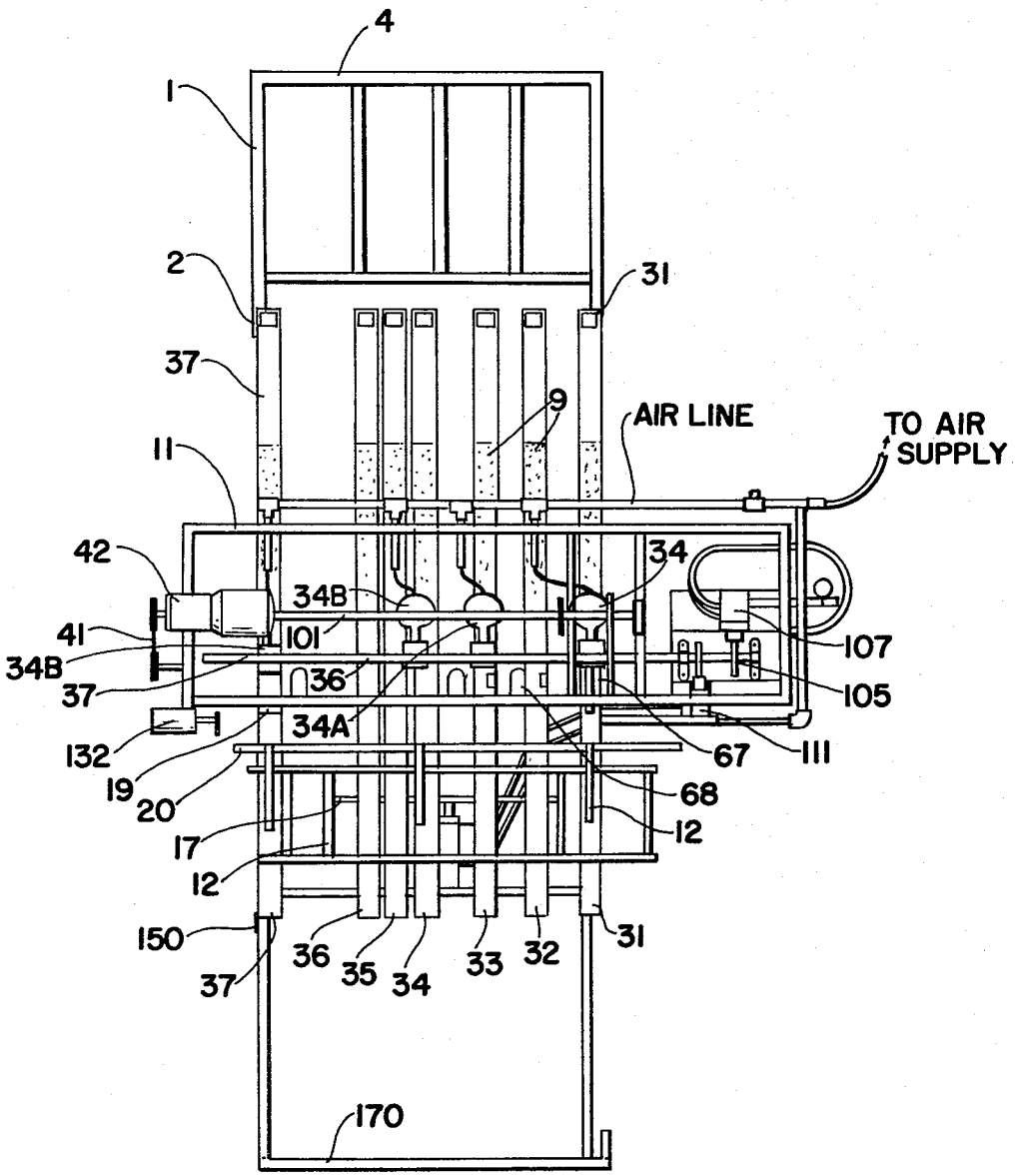
FIG. 2 is a top plan view of the apparatus.

FIG. 2 is a top plan view of the apparatus, and is useful in locating various parts as described in conjunction with the other figures to explain the operation of the apparatus. Certain features are shown in FIG. 2 which provide certain advantages as will be explained. The worktable of the apparatus can be extended to accomodate stringers as positioned in channels 31 to 37 of large lengths. An extendable rack 1 is pivotally mounted on the surface by means of pivots or hinges 2 to allow the unit to be easily stored. The rack 1 has a flange 4 upon which the end of the stringer as emplaced in a channel abuts. In a similar manner there is a rear rack 170 which is hinged to the worktable 11 via hinges 150. There is also shown a plate 21 which is shown in FIG. 1, the plate 21 contacts the tips or points of the pickets 30 as placed in the hopper or between posts 19 and 20 to align the stack of pickets 60. Also shown in FIG. 2 is a layer of material 9 located in each stringer channel as 31 to 37. The material 9 may be a carpet like or plastic material and is useful in assuring that the stringers when placed in the channels 31 to 37 will slide after a picket is nailed to each stringer and the assembly is pushed by the carriage 12. This material 9 can be plastic or any other material which will serve to allow easier sliding.

As will be described, the stringers for the fence are emplaced in channels 31 to 37. The channels 31 to 37 are perpendicular to the pickets 30. The top of the table, as will be evidenced from the top plan view of FIG. 2, has channels such as 31 to 37. The channels 31 to 37 are constructed of steel and have a U-shaped cross-section. Depending upon the height of a fence to be provided, the user inserts stringer boards or stringer members into the channels. For example, if one desires to provide a four feet fence, one would insert stringers into channels 34, 32 and 31. If one wishes to provide a fence of six feet in height, one would insert stringers into channels 31, 33 and 37. As will be explained, for each fence constructions, three stringers are used and therefore three guns or automatic nail fastening assemblies are used.

Referring back to FIG. 1, there is shown an automatic nail fastening assembly 34. Such devices are well-known in the prior art and for example, a suitable assembly is made by a company called Duo Fast of Franklin Park, Ill. One model of such a nail fastening assembly is the Model IN-124. This assembly is a pneumatic assembly which operates to emplace a nail when the plunger 35C has a pressure exerted upon it. Thus when the plunger 35 contacts the picket it will discharge a nail to secure the picket to the stringer.

In FIG. 2, there is shown three nail fastening assemblies 34, 34A, and 34B. Each device is pivotally mounted on an eccentric shaft 136 by means of a bronze bushing assembly 37. The fastening assemblies as 34 can therefore pivot on the shaft 136. Coupled to the shaft is a tooth gear 38 which is coupled to gears 39 and 40 via a sprocket chain 41. The gear 40 is directly driven by an electrical motor 42. As the motor rotates the shaft 136 which is rigidly mounted to the gear 38 will cause the fastening gun 34 to follow an oblong path. At the bottom of the path the plunger 35C will contact a picket and secure the same to the stringer, as will be explained.

Also shown in FIG. 1 is a first roller assembly 50. The roller assembly 50 is attached to a pivotable bar 51. The bar 51 may be coupled to a foot peddle or a similar device. The roller 50 is one of a plurality of rollers each of which is attached to a rod which is coupled to the pivot bar. As the rod is pivoted the rollers 50 are forced into the space between the posts 19 and 20. In this manner, the user can easily slide the stacked array of pickets into position between the posts as the rollers aid in doing so. Once the stack is in position between the posts, the rollers are retracted to cause the stack to rest on the surface of the worktable.

Figure 3:
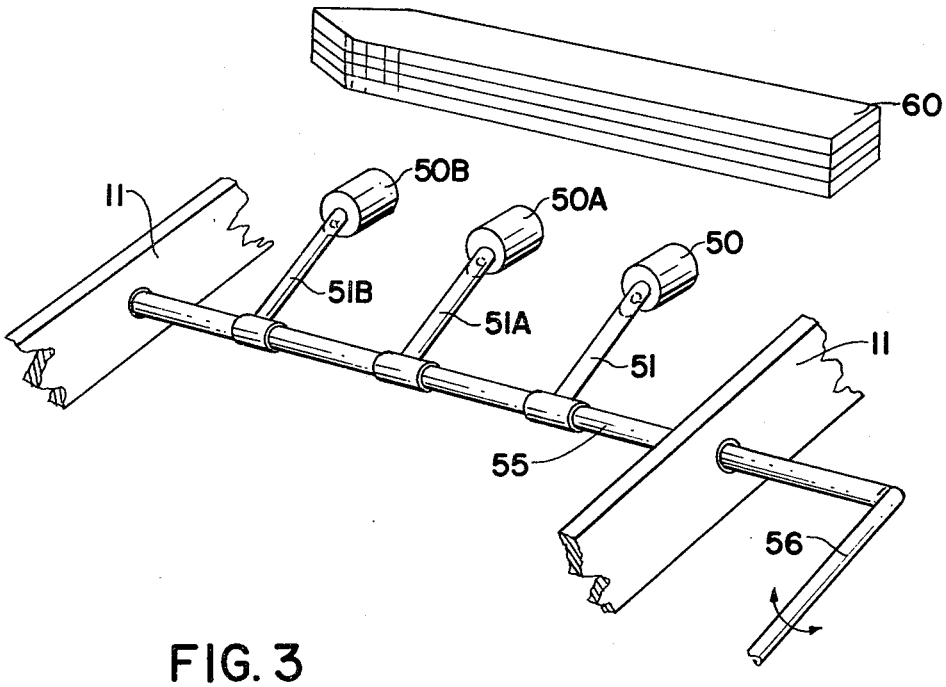
FIG. 3 is a perspective view of a picket loading apparatus according to this invention.

Referring to FIG. 3, there is shown a simple drawing of the mechanism to enable a clearer understanding. As can be seen from FIG. 3, a rod 55 is pivotally mounted on the frame 11 at both ends. The rod 55 has rigidly coupled thereto three extending rods as 51 51A, and 51B. Each rod holds a roller as 50, 50A and 50B which rotates in the direction shown. The stack of pickets as indicated by numeral 60 is pushed along the rollers when the handle 56 is pivoted in the direction shown. When the handle is released the rollers are withdrawn from the space and the stack of pickets is now resting on the worktable.

Also shown in FIG. 1 is an adjusting rod 61. The function of the rod 61 is to coact with the fastening assemblies as 34. The rod 61 can be moved parallel to the top of the worktable 11 and in moving the rod 61 in this position, one can cause the fastening assembly 34 to be adjusted so that it can make contact and insert a nail in a picket at a desired location. As will be explained, this adjusting rod will enable the apparatus to accomodate pickets of varying widths. A unique feature of the present invention resides in the fact that the apparatus will automatically accomodate a picket of any width and will secure that picket to the stringers in an automatic sequence.

Figure 4:
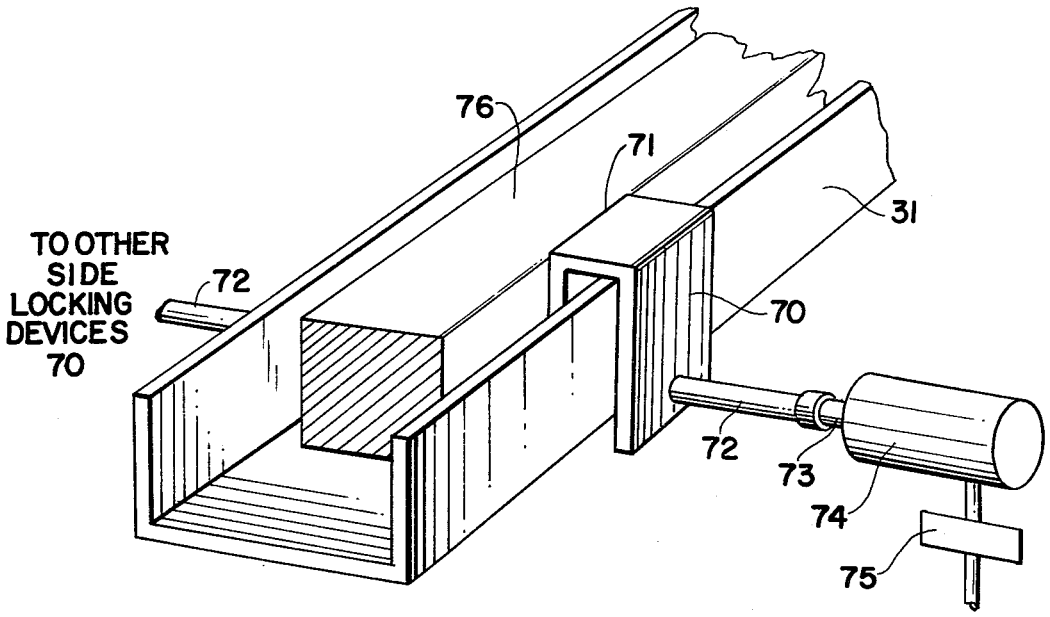
FIG. 4 is a perspective view of a stringer side locking apparatus.

Also included in each channel assembly is a side locking means which is shown in FIG. 4. The side locking means essentially consists of a movable plate 70 which has a flat front surface 71. The plate 70 is coupled to a shaft 72 which is attached to a piston rod 73 associated with a pneumatic cylinder 74. The cylinder 74 is also activated from the pneumatic source or air supply via an associated valve 75. The same air supply is used to actuate the cylinder 15. During reciprocating movement of the carriage assembly 12, the cylinder 74 pushes the plate 70 so that it makes contact with the side of a stringer beam 76 which is positioned in an appropriate channel such as channel 31. The flat front surface 71 of the plate 70 exerts a suitable force on the stringer 76 to maintain it in alignment and hold it secure during machine operation. When the machine is not operating the cylinder 74 is not activated and the piston 73 is retracted. In this position there is no force exerted on the side of the stringer 76 allowing the same to be easily removed from the channel 31.

Figure 4A:
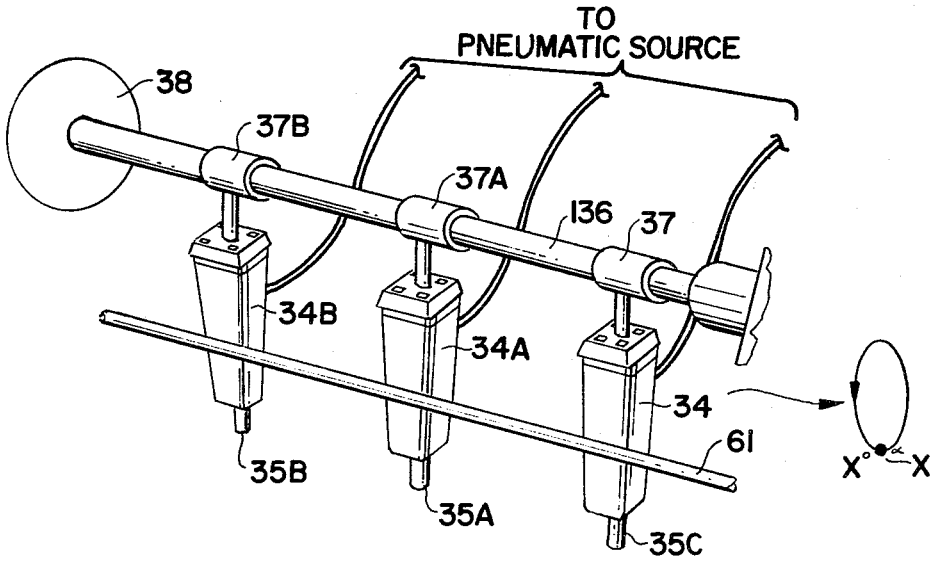
FIG. 4A is a plan view of a nailing gun or fastening assembly used in this invention.

Referring to FIG. 4A, there is shown three nail fastening means or nail guns 34, 34A and 34B, located on the eccentric shaft 36 as rigidly coupled to the toothed gear 38. As the gear 38 rotates the guns 34 traverse the arcuate path shown, which resembles an ellipse. At the bottom of the path X, the moveable plunger 35C contacts the picket and discharges a nail when compressed. The guns 34 operate pneumatically as is well known and are therefore connected or coupled to the pneumatic source for operation. Each nail gun as 34, 34A and 34B is coupled to the shaft 136 via bronze bearings 37 having locking collars to affix the guns in predetermined positions. The locking collars 37 may be loosened to allow one to move the guns along shaft 36 and therefore emplace nails at different stringer locations as determined by the stringer channels. The bar 61 is adjustably moveable and will contact the guns as they traverse the elliptical path to control the point X, which is where the plungers 35A, 35B, and 35C contact the surface of the picket, In this manner a nail can be emplaced at the center of the picket or elsewhere. The rod or bar 61 can also be reciprocated by means of a solenoid or air cylinder operative in synchronism with the path of gear 38, to cause two nails to be emplaced in each picket as one at X and one at X'. This operation is easily implemented by conventional mechanical techniques.

Figure 5:
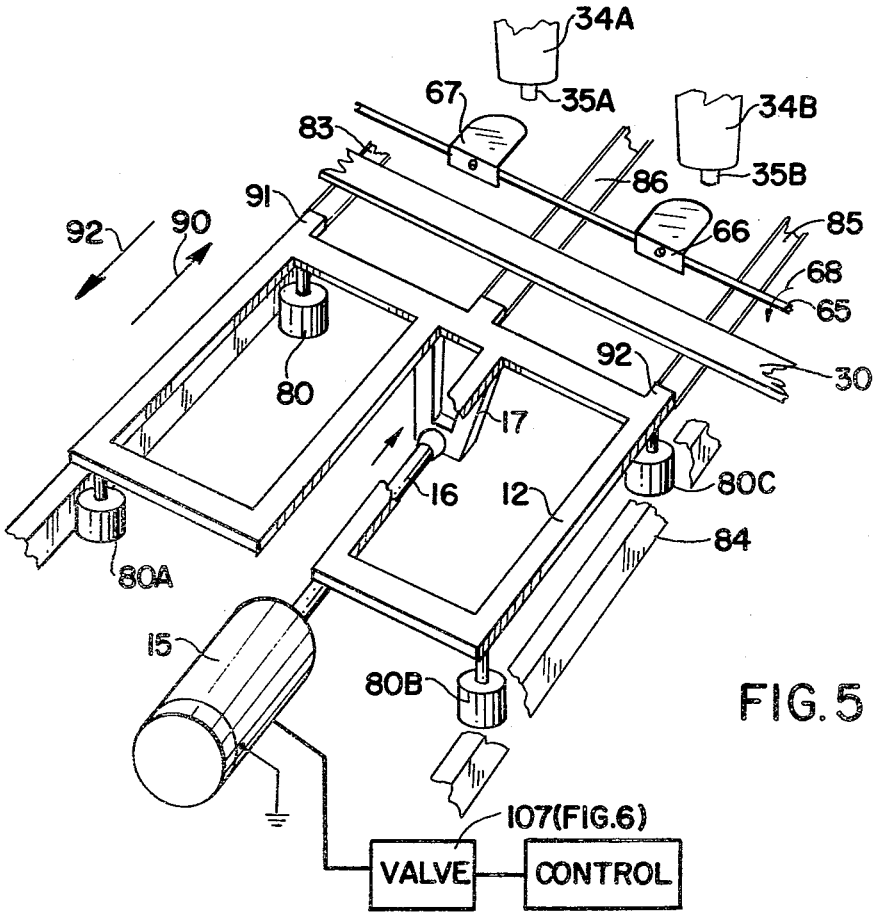
FIG. 5 is a plan view of a carriage assembly according to this invention.

Referring to FIG. 5, there is shown a simple schematic depicting the operation of the carriage assembly 12. Secured to the four corners of the carriage assembly 12 are a series of rollers 80, 80A, 80B and 80C. The sides of the rollers coact with a left and a right guide tracks as 83 and 84. As indicated, the bottom of the carriage is secured to the piston 16 associated with the cylinder 15 which cylinder is rigidly attached to the housing. The stroke of the piston 16 is always fixed and for example, in a typical device is six inches.

Shown in FIG. 5 is a slat or picket 30 which is positioned traverse to stringers 85 and 86. Shown positioned above the stringers are fastening guns 34A and 34B. As seen in FIG. 5 located above the picket 30 is a rod 65 which is secured to both sides of the frame and which holds picket hold down members 66 and 67. The members 66 and 67 are fabricated from a spring steel or other flexible material. As the carriage 12 moves forwardly, as will be explained, in the direction of arrow 90, the picket 30 is pushed and members 66 and 67 contact the picket to hold it securely against the stringers 85 and 86. In a similar manner, the bar 65 may be automatically rotated in the direction of arrow 68 to assure that the picket when moved into its final position by the carriage assembly 12 is firmly held in place by the hold down members 66 and 67.

The operation of the assembly is as follows:

The cylinder 15 is actuated via its associated valve and causes the piston 16 to move forward pushing the carriage in the direction of arrow 90. The projecting ends 91 and 92 of the carriage push the picket 30 the full amount of stroke which causes the picket 30 to be positioned beneath the fastening guns 34A and 34B. At the same time as the carriage is moving, the electric motor 42 rotates the gears 38, 39 and 40 which causes the fastening guns or means to contact the top surface of the picket 30. As the movable plungers are pushed into contact, a nail is discharged and the picket 30 is secured to the stringers as 85 and 86. In FIG. 5 only two stringers are shown for the sake of clarity.

It is also understood that as the carriage is moving forward, the cylinder 74 of FIG. 4 is also activated to push the stringers so that they are flush against the side wall of the channel as explained. When the carriage 12 is pushed to its maximum distance in the direction of arrow 90, the nailing plungers 35A and 35B are in contact with the picket due to the operation of the gear assembly and the eccentric shaft 136. The piston 16 is then withdrawn in the direction of arrow 92 which causes carriage to move backward or to its rest position. At this instance another picket falls onto the surface of the stringers 85 and 86. This action is strictly due to gravity. The cylinder 15 is again activated and the piston again undergoes its full stroke. The piston takes the next picket and pushes it against picket 30. The piston 16 completes the same six inch stroke and therefore the picket 30 which is secured to stringers 85 and 86 is pushed rearwardly in the direction of arrow 90 at a distance equal to the width of the picket. Thus as seen from FIG. 5, the next picket now automatically underlies the fastening guns 34A and 34B and therefore the next picket is now secured to the stringers. This process continues until all pickets in the hopper are secured to the stringers.

In regard to the above noted operation it is thus seen that the carriage 12 always moves forward and backward the same exact distance. Synchronization of the entire structure is controlled by a cam assembly which cam assembly is synchronized by the shaft of motor 42, as will be explained.

Figure 6:
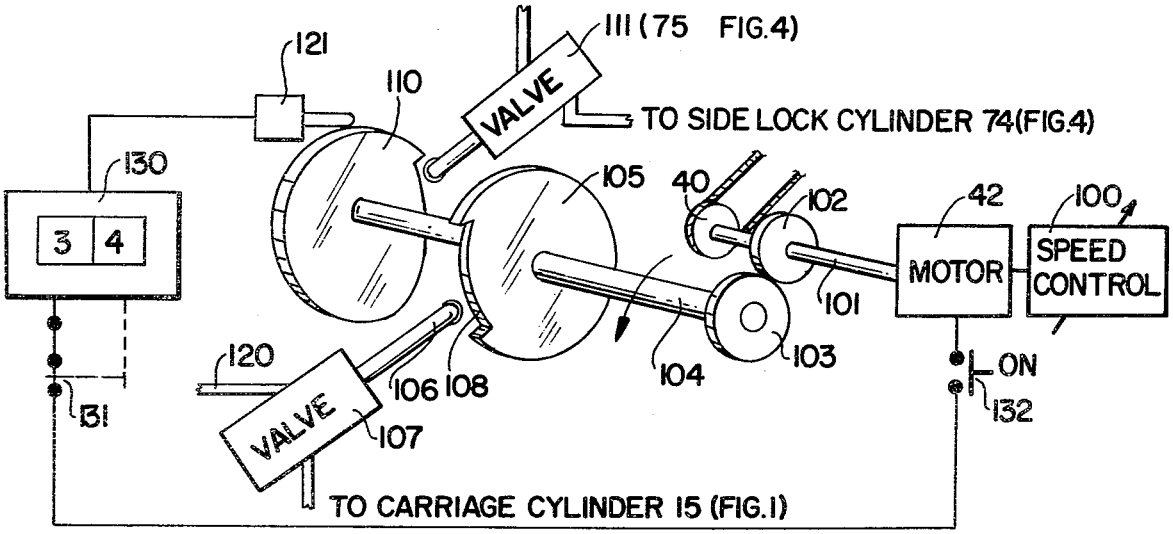
FIG. 6 is a partial schematic and assembly view of the control and synchronizing system for the apparatus.

Referring to FIG. 6, there is shown a simplified block diagram depicting the operation of the above described apparatus.

Essentially, an electrical motor such as motor 42 is a variable speed device as having a speed control circuit 100. The motor 42 may be an AC motor using a thyristor or SCR speed control circuit 100. In this manner, the speed of the motor can be controlled to cause the machine to go faster or slower. As will be understood, the operation of the machine is always in synchronism independent of the speed. The motor 42 has a shaft 101 which may be coupled to a suitable gear train as 102 and 103. The gear 102 may directly drive the gear 40 associated with the sprocket chain 41 of FIG. 1 and hence drive the eccentric shaft 36 to cause the nailing or fastening assemblies to always be in contact with the top surface of the picket at the proper moment. Gear 103 is associated with a shaft 104 which contains a first cam 105. Cam 105 is located in proximity with a valve stem 106 associated with air valve 107. As the shaft 104 rotates and therefore cam 105 rotates, it contacts the valve stem 106 for that portion of the cam of greater diameter.

In this position the valve 107 activates the cylinder 15 and therefore the piston 16 moves the carriage in the forward direction. As is seen in FIG. 6, there is a dead space 108 associated with cam 105. When the dead space appears the valve stem 106 cannot be actuated and the carriage is returned to its rest position. The dead space on the cam 105 is of a smaller dimension then the actuating surface of the cam. As indicated the valve 107 is a four way valve. When the cam activates the stem 106, air is directed to the inlet of the carriage cylinder 15 to raise the piston. When the dead space 108 releases the valve stem air is directed to the return port of the cylinder through the four way valve to lower the piston and therefore return the carriage to its rest position.

The shaft 104 also contains a second cam 110. Cam 110 controls valve 111 which operates the side lock mechanism shown in FIG. 4. In this manner the valve 111 allows air to actuate the locking mechanism when the carriage is reciprocating in the forward direction. In any event, the dead space on cam 110 is less than that of cam 105 to thus assure that a pressure is exerted on the stringers as the carriage is moving back. Valves 107 and 111 both have inlets as 120 and 121 which are coupled to a pneumatic source as an air pump or other suitable high pressure pneumatic supply. In any event, both valves 107 and 111 may be four way valves and will operate both the carriage cylinder 15 and the side lock cylinder 74 by causing the associated pistons to move forward when the cam surface is actuating the valve stem by introducing air into one cylinder port and to be retracted during the dead space by introducing air into the other cylinder port. As indicated, four way valves, as well as pneumatic cylinders which operate in this manner are known in the art and are available as conventional commercial components. Thus as can be seen from FIG. 6, the entire assembly is synchronized to the arcuate motion of the fastening heads as controlled via the eccentric shaft and sprocket and gear assembly.

Also shown in FIG. 6 is a pressure actuated switch 121. Switch 121 may be a Microswitch and essentially rides on the raised surface of either cam 110 or cam 105. Thus as the cam rotates, the switch will stay closed until the dead space underlies the contacts. When this occurs the switch opens or closes and sends a pulse to a preset counter 130. Counters as 130 are well-known in the art and both mechanical or electrical counters can be employed. The counter 130 is preset by the operator to a number equal to the number of pickets placed in the hopper assembly or between posts 19 and 20. In this manner, each time the dead space of the cam rotates past the switch 121, the counter decrements by 1. This indicates that a picket has been secured to the stringers. Thus before a picket is secured to the stringers the counter 130 is preset to the number 34. When the first stringer is secured as evidenced by a complete rotation of cams 105 and 110 the switch 121 decreases the count of 34 by 1. Thus as one can see, when all 34 pickets are fastened to the stringers, the counter will read zero. The counter 130 is associated with a contact 131 which is in series with the ON switch 132 associated with the motor 42. When the counter 130 is at zero, contact 131 is opened. This removes ground from the motor and therefore inactivates the motor as there are no more pickets available in the hopper. In this manner the operator can turn the machine ON and go about his business while being assured that the fence is being constructed and that the machine will in fact shut OFF after the correct number of pickets as placed into the hopper has been secured to the stringers.

The ON button 132 may be a jog button to enable an operator to engage the electric motor 42 in other operations. In this manner the cam assemblies as 105 and 110 will activate the air valves 107 and 111. By doing this the operator can retract the carriage 12 and therefore emplace the pickets on the stringers in an automatic operation. As can be seen, when the carriage moves forward, its forward motion carries the bottom picket from the stack of pickets always to the proper position which cause the nail guns as 34A and 34B to nail the picket to the stringers. As explained, the rotation of the cams are synchronized with the eccentric shaft 136 which raises and lowers the pneumatic nail guns. When the cams reach the dead space, the carriage 12 is retracted and the next picket is dropped into position. The carriage 12 comes forward again and pushes the picket flush against the previous picket. This causes the entire assembly to move the distance equal to the width of one picket as the piston 16 will always complete a full stroke. The picket hold down as 66 of FIG. 5 assures that the picket firmly engages the stringers. It is of course understood that the side locking means as shown in FIG. 4 always assures that the stringers are pushed flushed against the side of the channels. The entire operation of the machine assures that each picket is straightened due to the pressure and therefore is flush with the previous picket. In the same manner, the side locking device assures that the stringers are also properly aligned. The resulting structure is a fence section which is completely aligned and extremely attractive in appearance.

I claim:

1. Apparatus for securing pickets transversely to elongated stringers, comprising:

a relatively horizontal work surface, hopper means located on the top surface of said work surface and adapted to hold a predetermined number of pickets in a vertical stacked relationship with respect to the top surface of said work surface, a channel assembly located on said work surface and transverse to said hopper means and adapted to support at least one elongated stringer, a carriage assembly mounted above said channel assembly and adapted to movably reciprocate with respect to said hopper always at given distance in a forward and backward direction, means coupled to said carriage assembly to reciprocate the same said fixed distance to push one picket from said hopper to a fastening location, at least one fastening means located at said location and positioned above said picket, said fastening means operative to move in an arcuate path to contact said picket and to secure the same to said stringer when said arcuate path causes said fastening means to contact said picket when said carriage is operated in said forward direction at said given distance wherein said fastening means is coupled to a shaft means with said shaft means coupled to an eccentric gear capable of rotating to cause said shaft means and therefore said fastening means to traverse said arcuate path.

2. The apparatus according to claim 1 further comprising:

selectively actuated side locking means located in said channel assembly and operative when selected to push said stringer against the side wall of said channel assembly to exert a force on said stringer, and means coupled to said side locking means for actuating the same when said carriage assembly is moving.

3. The apparatus according to claim 1 further including:

a preset counter means capable of being set to a number indicative of the number of pickets in said hopper means, and control means coupled to said counter and responsive to the number of pickets nailed to said stringer to terminate operation of said apparatus when a given number of pickets as set by said counter are secured to said stringer.

4. The apparatus according to claim 1 further including retractable sliding means located on said work surface and underlying said hopper means to allow a stack of pickets to slide into said hopper when said sliding means are in a first position and to cause said pickets to lie on said work surface when said sliding means are retracted in a second position.

5. The apparatus according to claim 1 further including positional adjustment means coacting with said fastening means and operative to vary the point at which said fastening means contacts said picket as said fastening means traverses said arcuate path.

6. The apparatus according to claim 1 further including picket hold down means located at said fastening location and adapted to grasp said picket as pushed to said location by said carriage assembly.

7. The apparatus according to claim 1 wherein said means coupled to said carriage assembly to reciprocate the same is a fluid actuated cylinder having a piston rod, with said rod coupled to said carriage to reciprocate the same.

8. The apparatus according to claim 1 further including a chain drive coupled to said gear at one end and coupled to drive shaft of an AC motor at said other end, and with said drive shaft further coupled to a cam assembly for controlling the motion of said carriage assembly.

9. The apparatus according to claim 8 further including variable speed control means coupled to said motor for varying the speed of the same and therefore the speed of operation of said shaft and carriage assembly.

10. The apparatus according to claim 1 whereby said picket as secured to said stringer is pushed said given distance by a next picket as moved by said carriage to cause said fence assembly to move from said location via said channel as each picket is secured to said stringer.

* * * * *